United States Patent [19]

Claver

[11] 4,411,118

[45] Oct. 25, 1983

[54] PANEL SET FOR THE FORMATION OF ATHERMANOUS WALLS

[76] Inventor: Jorge C. Claver, Provenza 474, Barcelona, Spain

[21] Appl. No.: 255,041

[22] Filed: Apr. 17, 1981

[30] Foreign Application Priority Data

Apr. 30, 1980 [ES] Spain ..... 250.369[U]

[51] Int. Cl.[3] ..... E04C 1/10

[52] U.S. Cl. ..... 52/582

[58] Field of Search ..... 52/582, 583, 585, 588, 52/587, 586, 593; 292/74, 302

[56] References Cited

U.S. PATENT DOCUMENTS

| | | | |
|---|---|---|---|
| 296,229 | 4/1884 | Sears | 292/74 |
| 1,200,911 | 10/1916 | Arensman | 292/74 |
| 2,647,287 | 8/1953 | Jones | 52/582 |
| 2,788,981 | 4/1957 | Emerson | 292/74 X |
| 3,327,447 | 6/1967 | Nissley | 52/582 |
| 3,508,369 | 4/1970 | Tennison | 52/583 X |

*Primary Examiner*—Philip C. Kannan
*Attorney, Agent, or Firm*—Staas & Halsey

[57] ABSTRACT

A panel set for the formation of athermanous walls, each panel comprising a central core made from insulating plastics material and formed between two rigid sheets. The connection between panels is effected by coupling devices, each of which is formed by two mating elements, the corresponding elements of one coupling device are located on adjacent panels. One of the mating elements is provided with an outwardly active male member and the other mating element is provided with an active female member, adapted to receive the male member. The female mating element has an adjustable retractable resilient stop adapted to allow the insertion and retention of the panels together and to force juxtaposed panels closer together.

9 Claims, 12 Drawing Figures

Fig. 1
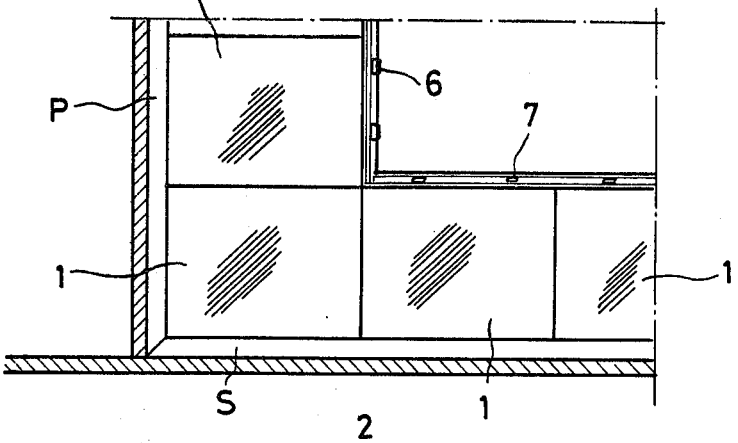
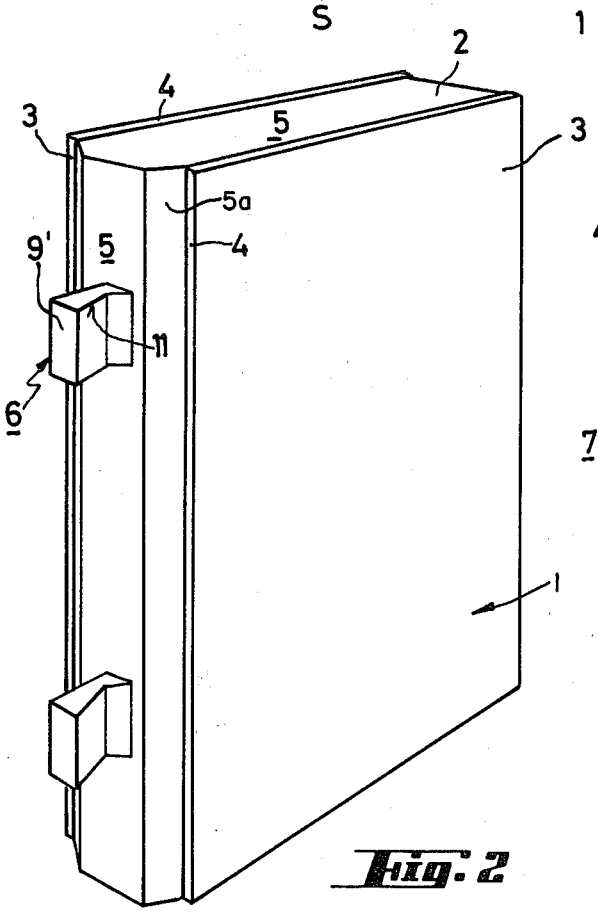
Fig. 2
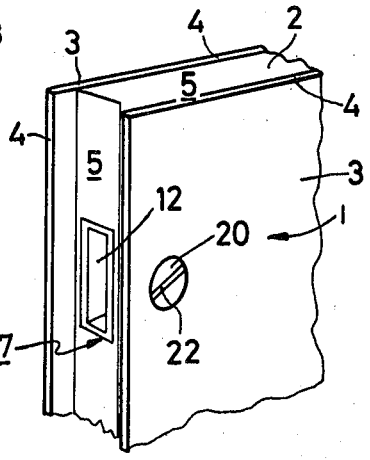
Fig. 3

PANEL SET FOR THE FORMATION OF ATHERMANOUS WALLS

FIELD OF THE INVENTION

The invention relates to a panel set for the formation of athermanous walls, each panel comprising a central core of insulating plastics material between two rigid lateral, substantially sheetlike structures, each panel having edges juxtaposable to the edges of other panels. The invention relates also the the coupling device for connecting panels of the sets together.

DESCRIPTION OF THE PRIOR ART

Panel sets of the above type are already known, wherein the connection between panels is effected by U-shaped members. In these panel sets, each leg of the U-shaped member penetrates in respective slots in the rigid lateral structures covering the central cores of two adjacent panels. The member extends a considerable way from the junction between panels. This also requires two U-shaped members for each pair of panels, one on each side thereof.

Such a system requires the lateral structure to be of a special formation, it being necessary for it to be provided with the slots and the U-shaped members fixed in place by bolts, requiring in turn suitable nuts to receive them. Also, when a panel is to be juxtaposed to a further four panels, one on each edge thereof, the slots must be provided along the panel edges and, as has already been stated, on both sides thereof.

It also is not easy to assemble the panels, since they must be held juxtaposed while the U-shaped members are being fitted and it is necessary to work on both sides of the wall being formed with the panels practically at the same time.

SUMMARY OF THE INVENTION

To overcome the disadvantages of the above and other known embodiments, a panel set of the type described hereinbefore has been devised, characterised fundamentally in that each panel has attached thereto an element of at least one coupling device formed of two mating elements. The coupling device includes, a male element having an outwardly extending active member and a female element having an inwardly extending active member provided with an inlet opening. The mating elements constitute one coupling device on two separate panels. The active female member is adapted to receive insertion of the active male member when the panels are juxtaposed with the female element having an adjustable retractable resilient stop adapted to allow the insertion and retention of the panels together and to force juxtaposed panels closer together.

BRIEF DESCRIPTION OF THE DRAWINGS

To facilitate the understanding of the foregoing, reference is made hereinafter to the accompanying drawings which, in view of its illustrative nature, should be deemed to be devoid of any limitation with respect to the scope of legal protection being claimed. In the drawings:

FIG. 1 is a perspective view of a panel set according to the invention, forming an athermanous wall and abutting a floor S and wall P illustrated in cross section;

FIG. 2 is a perspective view on a larger scale of a panel provided with male elements of a coupling device according to one embodiment of the invention;

FIG. 3 is a perspective view of part of a panel having a female element of a coupling device according to the invention;

DETAILED DESCRIPTION OF THE PREFERRED EMBODIMENTS

Figure 4:
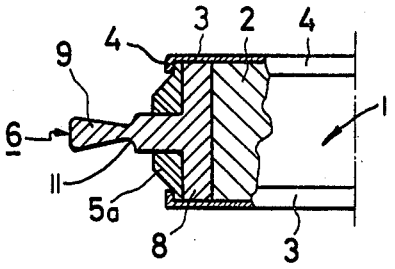
FIG. 4 is a partial cross-sectional view showing a male mating element of a coupling device according to the invention insertably connected in a panel having a convex outer edge.

With reference to the drawings, particularly FIG. 1, there is illustrated in the first place a set of panels 1 formed by a number of panels juxtaposed edge on, partly forming a wall having athermanous properties. This panel set prevents the passage of heat as a consequence of the properties of the panels to be described hereinafter. In FIG. 1, the athermanous wall formed by the panels is supported on a floor S and a wall P.

In a preferred embodiment, and as best seen in FIGS. 2–5 each panel 1 comprises a central core 2 of lightweight, insulating plastics material, preferrably injected foam polyurethane. The central core 2 is sandwiched between two rigid lateral structures 3 which provide the necessary strength and rigidity to the panel and to the wall formed by a set thereof. Preferably the lateral structures 3, which are substantially sheet-like, are formed by metallic sheets covering the front walls of the panel and are provided with perpendicular flanges 4 covering a marginal portion of an edge 5 of the panel. The front dimensions of the panel are as appropriate for each case, although the panels often measure from 30×30 cm to 90×450 cm. The panels are plane, although right-angled panels are contemplated for forming the corners of the athermanous walls.

Each panel is provided with at least one element of a coupling device (shown complete in cross-section in FIG. 10) formed by two mating elements, one of which is a male element 6 and the other a female element 7.

Nevertheless, with the exception of the smaller sized panels, it is desirable for the same edge 5 of a panel 1 to be provided with a plurality of elements of the same type and the opposite edge to be provided with the other mating elements and the same happens with the edges between said opposite edges. It is, moreover, preferred for the location of such elements to be such that when one panel is juxtaposed at the edge on to another panel, the mating elements mate so that each pair of mating elements, one on one panel and the other on a juxtaposed panel, form a coupling device.

Preferbly, the panels which are to form a particular athermanous wall are all the same, so as not to have to select each time the desirable panel to be juxtaposed to another. The above may obviously require an exception in the panels located on two adjacent edges of an athermanous wall, according to the dimensional requirements of the two walls P and floor S and the ceiling which may delimit the extension of the athermanous wall. Moreover, there may be an exception for the panels forming corners.

Preferably, the mating elements on the same edge of a panel are disposed symmetrically relative to the ends of the edge itself and also the distance of one terminal element to the extreme end of the edge is half the distance between two consecutive elements.

Figure 5:
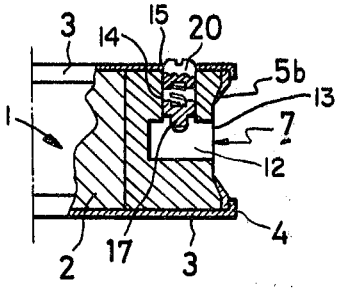
FIG. 5 is a partial cross-sectional view showing a female mating element of a coupling device according to the invention insertably connected in a panel having a concave outer edge.

The panel edges 5 having mating elements of the same type are preferably convexly shaped as shown by reference numeral 5*a* in FIG. 4 with dimensions mating those of concave shaped panel edges 5*b* shown in FIG. 5 having the opposing mating elements, this provides for a better sealing of the athermanous wall formed by a set of panels. Preferably, and as shown in FIGS. 4 and 5 the convex panel edges 5*a* are provided with the male mating elements 6 and the concave panel edges 5*b* have the female mating elements 7.

Figure 10:
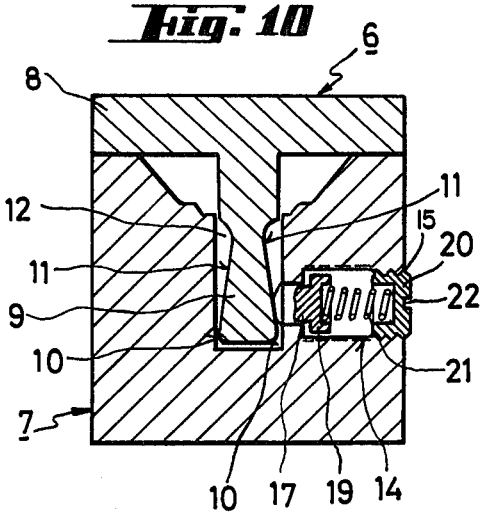
FIG. 10 is a cross-sectional view, along the lines X—X of FIG. 9, but with the stem of the male mating element being inserted into the slot of the female mating element the retractable stop in the female element engaging the stem of the male element, the stop spring slightly tensioned, and the convex and concave edges of the panels omitted.
Figure 7:
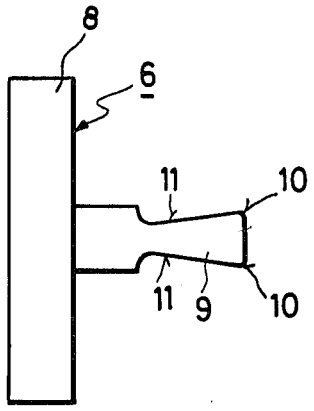
FIG. 7 is a side view of the male mating element of the coupling device illustrated in FIG. 4.

As shown in FIG. 4, the male element 6 is provided with an anchor portion 8 trapped in the central core 2 of the panel 1 and an active male member or stem 9 extending outwardly from the convex panel edge 5*a*. Preferably, and as seen FIGS. 4, 7 and 10 the stem 9 is provided with bevelled corners 10. The stem 9 is also provided with at least one flank 11 having an inwardly tapering surface, the thickness of the stem reducing in the direction of the anchor portion. FIG. 2 shows a stem 9' of a male mating element 6 as provided with a single flank 11 with the above features, whereas FIGS. 7 and 10 illustrate the stem 9 having two flanks 11 with said features, the flanks being symmetrical in this case about a median plane. The advantages to be derived from this shape of the flanks will be described hereinafter.

Figure 8:
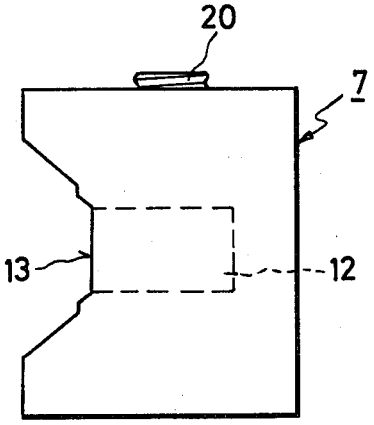
FIG. 8 is a side view of the female mating element of the coupling device illustrated in FIG. 5.
Figure 9:
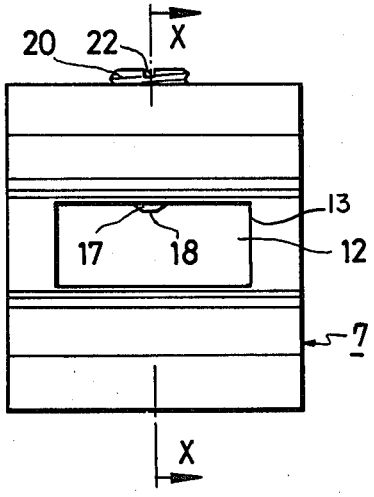
FIG. 9 is a plan view of the female mating element of the coupling device illustrated in FIG. 5.

On the other hand, and as best seen in FIG. 8, the female mating element 7 is provided with a female member or slot 12 with opening 13. The female slot 12 is of a size sufficient to allow the insertion therein of the male stem 9 with a clearance. In the panel 1 as shown in FIG. 5, the female element 7 is trapped in the central core 2 of the panel and the opening 13 is flush with the concave edge 5*b* of the panel.

Figure 11:
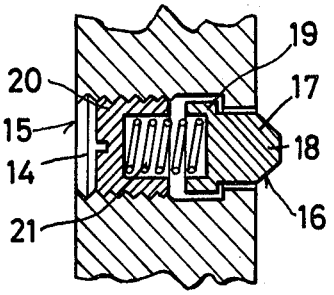
FIG. 11 is a cross view, sectional similar to FIG. 10, but illustrating the resilient retractable stop in a position of high spring tension.
Figure 12:
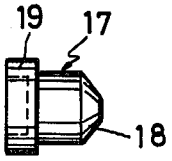
FIG. 12 is a side view of the stop which is located in the female element of the coupling device according to the invention.
Figure 6:
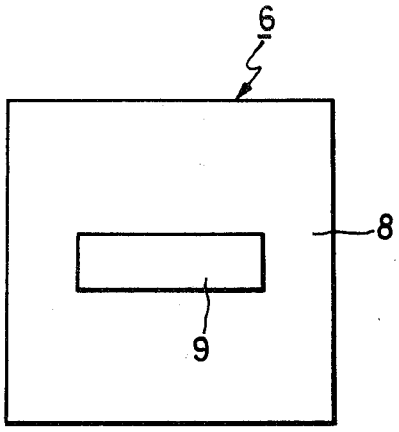
FIG. 6 is a plan view, on a larger scale, of the male mating element of the coupling device illustrated in FIG. 4.

As best seen from FIGS. 5, 10, and 11, the female element 7 is provided also with a bore 14 which is partly threaded and which is provided with a first open end 15 on the outside of the female element 7 and a second open end 16 in the slot, the second open end 16 being smaller than the first open end 15. In the bore 14 there is housed a resilient retractable stop 17 having a substantially frustoconical end 18 penetrating in the slot 12 through the open end 16. The frustoconical end 18 extends from a disc 19 having a diameter larger than that of the open end 16, whereby it may not penetrate in the slot 12.

At the other end of the bore 14 there is the threaded stud 20 screwed in said bore and between the stud 20 and disc 19 there is a spring 21 which, in the illustrated embodiment, is a helical spring tending to force the stop 17 apart from the threaded stud 20. The stud may be manipulated from the outside of the panel 1, to which end it is provided with a slot 22.

The bore is made in such a way that when the male stem 9 is inserted in the slot 12, the end 18 of the resilient retractable stop 17 bears against the flank 11, whereby the force of said end on the sloping flank 11 causes a force component in the direction of insertion so as to urge the mating elements together. Therefore, the respective panels are attached by the mating elements.

The male and female elements 6 and 7 are made preferably from plastics material, such as nylon, having great rigidity and strength. Moreover, since this material is not a good heat conductor, the possibility of heat losses through such elements is avoided.

Nevertheless, the elements 6, 7 may also be metallic, it being necessary, nevertheless, for such metal to be rustfree. In such a case, possible heat losses occur therethrough. Nevertheless, they are small since the transmission surfaces which the elements represent is very small in comparison with the total panel area. If metal elements are used, however, care must be taken that they do not contact the metal sheeting forming the lateral structures 3, by locating therebetween plastics material of the central core 2. In this way undesirable vapour condensation in the areas of the panel surface in contact with the elements 6 and 7, which would be at a different temperature from the rest of the panel, is avoided.

From the foregoing, it may be easily appreciated how the panel set is assembled. By simply juxtaposing two panels through the edges provided with mating elements, the stem of the male elements is inserted in the slot of the female elements. During the insertion operation, the bevels 10 of the head of the male stem 9 bear against the frustoconical end 18 of the resilient retractable stop 17, thereby overcoming the force of the spring. The stop 17 retracts and allows complete insertion of the stem 9. After this, the retractable stop 17 advances again and bears against the flank 11, thereby forcing the mating elements together, with the resulting pressure between the panel edges 5 improving the sealing of the panel set.

To dismantle the panels, it is sufficient to separate them, whereby the flank 11 forces the stop 17 into the bore 14 against the force of the spring 21. Nevertheless, as stated above, the retractable stop 17 is adjustable by the threaded stud 20. Therefore, if the stud 20 is screwed into the bore 14, it may reach the position illustrated in FIG. 11, wherein the helical spring is fully compressed, thereby preventing recoil of the stop 17 and, therefore, the possibility of separating the panels. In this position of maximum tension of the spring 21, the force of the stop 17 against the flank 11 of the stem 9 is greater and consequently the component forcing the panel edges together is also greater.

To dismantle the panels, it is sufficient to slacken off the threaded stud 20 and consequently reduce the pressure of the spring 21, which will allow the male element to be separated from the female element, as mentioned hereinbefore.

From the foregoing, the advantages of the panel set and coupling device of the invention will be appreciated. Such advantages may be summed up as follows: ease of assembly by simple juxtapositioning of the panel edges; immediate retaining of the male element stem in the female element slot by means of the retractable stop; tendency of the mating elements to be forced together by the end of the stop bearing against the stem flank; ease of adjustment of the spring pressure, with the possibility of making the stop recoil impossible; simplicity of the operations required for dismantling the panels and, moreover, the athermanous walls formed by the panels have a smooth surface.

What I claim is:

1. A panel set for the formation of athermanous walls comprising:

(a) panels for forming an anthermanous wall, each panel being formed for two rigid lateral, substantially sheet-like members and a central core of insulating plastics material between the sheet-like members, and having edges juxtaposable to corresponding edges of another panel; and (b) coupling means fixedly connected to said panels for juxtaposably coupling one panel to another panel and including:

(i) a male mating element fixedly attached to a panel at an edge thereof and having an outwardly extending active member with at least one flank lateral surface inwardly tapered toward the panel edge to which said male mating element is attached;

(ii) a female mating element fixedly attached to a panel at an edge thereof and having an inwardly extending active member with an inlet opening adapted to receive insertion of the active male member of another panel when the panels are juxtaposed together at respective edges thereof; and (iii) an adjustable resilient retractable stop means positioned in said female mating element for allowing insertion of said male active member and having a generally frustoconical end for engaging said inwardly tapered flank lateral surface of said male active member upon insertion and tightening the juxtaposed panels closer together at the respective edges thereof.

2. The panel set of claim 1, wherein the panel edge housing one or more of the mating elements of the same type is concave and the panel edge housing one or more of the mating elements of the other type is convex with dimensions for mating into the concave edge of a juxtaposed panel.

3. The panel set of claim 2, wherein the active female member of the female element is a slot having a size adapted to house the male active member with a clearance, wherein the female mating element further includes a partly threaded bore having a first open end on the outside of the female member and a second open end in the slot, wherein said retractable stop means comprises a resilient retractable stop partly housed in said bore with a substantially frustoconical end facing the female element for engaging the tapered flank surface of the male active member upon insertion, a threaded stud threadably inserted in the bore and adjustable outside the panel from the first open end of the bore and a spring between the stop and stud tending to force the resilient stop and the threaded stud apart, the spring tension being changed by adjustment of the stud.

4. The panel set of claim 1, wherein each element of a coupling device is fixedly positioned in the central core of a panel, the active member of each male element extending outwardly from one edge of the panel and the inlet opening of the active member of each female element being on one edge of the panel.

5. The panel set of claim 4, wherein the male mating element further comprises an anchor portion fixedly positioned in the central core of the panel and wherein the outwardly extending active member comprises a stem having at least one flank inwardly tapered in the direction of the anchor portion.

6. The panel set of claim 1, 4, 5, wherein the distance between two consecutive mating elements on the same panel edge is constant and substantially double the distance from an extreme element to the end of the panel edge.

7. The panel set of claim 1, 4 or 5, wherein the active female member of the female element is a slot having a size adapted to house the male active member with a clearance, wherein the female mating element further includes a partly threaded bore having a first open end on the outside of the female member and a second open end in the slot, wherein said retractable stop means comprises a resilient retractable stop partly housed in said bore with a substantially frustoconical end facing the female element for engaging the tapered flank surface of the male active member upon insertion, a threaded threadably inserted in the bore and adjustable outside the panel from the first open end of the bore and a spring between the stop and stud tending to force the resilient stop and the threaded stud apart, the spring tension being changed by adjustment of the stud.

8. The panel set of claim 1, 4, or 5, wherein the stem has two symmetrical flanks inwardly tapered in the direction of the anchor portion.

9. The panel set of claim 8, wherein the active female member of the female element is a slot having a size adapted to house the male active member with a clearance, wherein the female mating element further includes a partly threaded bore having a first open end on the outside of the female member and a second open end in the slot, wherein said retractable stop means comprises a resilient retractable stop partly housed in said bore with a substantially frustoconical end facing the female element for engaging the tapered flank surface of the male active member upon insertion, a threaded stud threadably inserted in the bore and adjustable outside the panel from the first open end of the bore and a spring between the stop and stud tending to force the resilient stop and the threaded stud apart, the spring tension being changed by adjustment of the stud.

* * * * *